United States Patent [19]

Nishizawa et al.

[11] Patent Number: 4,831,504

[45] Date of Patent: May 16, 1989

[54] HOLDER WITH SEMICONDUCTOR LIGHTING DEVICE

[75] Inventors: Junichi Nishizawa, No. 6-16, Komegafukuro 1-chome, Sendai-shi, Miyagi; Yoshikatsu Tamaoki, Sendai, both of Japan

[73] Assignee: Junichi Nishizawa, Miyagi, Japan

[21] Appl. No.: 929,884

[22] Filed: Nov. 13, 1986

[30] Foreign Application Priority Data

| | | | |
|---|---|---|---|
| Nov. 13, 1985 | [JP] | Japan | 60-175511[U] |
| Mar. 25, 1986 | [JP] | Japan | 61-66154 |
| May 15, 1986 | [JP] | Japan | 61-113237 |
| Jul. 8, 1986 | [JP] | Japan | 61-161720 |

[51] Int. Cl.[4] ..... E05R 17/10

[52] U.S. Cl. ..... 362/100; 362/116; 362/184; 362/800; 70/456 R

[58] Field of Search ..... 362/100, 116, 184, 189, 362/200, 800, 802, 806, 109, 119, 120; 70/456 R

[56] References Cited

U.S. PATENT DOCUMENTS

| | | | |
|---|---|---|---|
| 3,804,307 | 4/1974 | Johnston | 362/116 |
| 4,161,018 | 7/1979 | Briggs et al. | 362/800 |
| 4,215,388 | 7/1980 | Reimann | 362/800 |
| 4,271,408 | 6/1981 | Teshima et al. | 362/800 |
| 4,480,295 | 10/1984 | Shuster | 362/119 |
| 4,521,833 | 6/1985 | Wolter | 362/100 |
| 4,677,533 | 6/1987 | McDermott et al. | 362/800 |

FOREIGN PATENT DOCUMENTS

| | | | |
|---|---|---|---|
| 0188253 | 7/1986 | European Pat. Off. . | |
| 914415 | 7/1954 | Fed. Rep. of Germany | 362/200 |
| 2016576 | 9/1979 | United Kingdom . | |
| 2024914 | 1/1980 | United Kingdom . | |
| 2072742 | 10/1981 | United Kingdom . | |
| 2079838 | 1/1982 | United Kingdom . | |
| 2159567 | 12/1985 | United Kingdom . | |
| 2171144 | 8/1986 | United Kingdom . | |
| 2172928 | 10/1986 | United Kingdom . | |

*Primary Examiner*—Samuel Scott
*Assistant Examiner*—Noah Kamen
*Attorney, Agent, or Firm*—Sughrue, Mion, Zinn, Macpeak & Seas

[57] ABSTRACT

An illuminated tool or key, in which a light source is detachably secured to a surface of the tool or key. Additionally, the emitted light can be modulated to perform an additional keying function when received by the lock. A three-color light emitter is preferable.

4 Claims, 10 Drawing Sheets

HOLDER WITH SEMICONDUCTOR LIGHTING DEVICE

BACKGROUND OF THE INVENTION

1. Field of the Invention

The present invention relates to a lighting device and specifically to a portable lighting device, that is miniaturized, light weight and easy to carry. The invention particularly relates to a portable lighting device which can be attached to key, a tool, a pen or the like.

The locking/unlocking device according to the present invention is also directed to a system in which a door, a safe, a lock or the like (all are generally referred to as "a lock" in the present invention) is opened or closed safely and correctly according to the both the operation of a key, a card, or the like, (these are generally referred to as "a key" in the present invention), and according to a predetermined light signal.

2. Background Art

Heretofore, a holder of the intended type mainly has been used as a key holder. Accordingly, a conventional key holder will be described hereunder as an example of the holder.

Generally, with respect to a conventional key holder, a holder body and a key are connected to a cylindrical ring or to a chain through a necessary setting member or clamp. Accordingly, the conventional key holder has a disadvantage of being bulky to carry about and, particularly, it becomes more bulky to carry about as the number of keys increases.

Furthermore, in the case where locking and unlocking is to be performed by the use of a key in a poor visibility condition, for example, at night or in a dark place, it is necessary to hold a lighting device with one hand and at the same time handle the key with the other hand because the conventional key holder, as well as the key, has no lighting device. Accordingly, the conventional key holder has a disadvantage of being inconvenient to handle. Moreover, a so-called flashlight has been mainly used as the conventional lighting device. However, the flash light has a disadvantage of poor visibility in lighting a limited small area such as a keyhole while it nonetheless has the advantage of being able to light a wide area.

Heretofore, in the case of a key carrier, the key has been mounted to a chain-like member or the like connected to a key holder body and the key has not been directly united or connected to the body forming the object to be held of the key holder. In this case, no problem worthy of mention has arisen with respect to the carrying of the key. However, when the key is used under poor visibility condition such as darkness, there has been the inconvenience of searching for a keyhole by feeling. However, a key holder capable of lighting a keyhole has been proposed. In the proposed illuminating key holder, however, the illuminating key holder has been integrally fixed to the key. Therefore, it has been necessary to make two operations for illumination and for turning the key requiring two hands in the troublesome manner.

With further industrial development and with the increase in the standard of living the use of locks or the like has increased. As a result, it has become common for a person to carry a number of keys, cards, or the like. Accordingly, a key is often dropped or lost, and the key itself is often stolen, so that the key can be used by another person to the detriment of the owner. Accordingly, the conventional locking/unlocking devices have been disadvantageous even in view of its intended safety. At present there is no provision for making it difficult to open a lock with a key found or stolen by another person.

SUMMARY OF THE INVENTION

An object of the present invention is to provide a lighting device which can be attached to a key, a tool, or the like, by which work in a dark place or small-scale operation can be performed accurately and speedily, and which is extremely convenient to carry.

It is a further object of the present invention to provide a key holder for making it simple to turn a key under poor visibility conditions.

In order to solve the above-mentioned problems, the lighting device according to the present invention has a casing that includes means for connecting a semiconductor light-emitting device to a key, a tool, or the like.

In order to solve the problem of lost keys, the lock opening/closing device according to the present invention comprises a signal generation source and a light-emitting section for producing a predetermined light signal to be applied to an object having a lock function, and also includes a key joined with or separated from the light-emitting section.

The light-emitting section is arranged to be used not only for the purpose of emitting a light signal but for the purpose of illumination while emitting the signal light when used at night, or in a dark place or the like.

The holder according to another aspect of present invention at least has a plurality of light-emitting elements and a signal generator, or a plurality of light-emitting elements and a key.

The key and the holder may be attached to each other through connecting means or may be integrally formed without using connecting means.

DETAILED DESCRIPTION OF THE PREFERRED EMBODIMENTS

Now, the definitions of terminology used in this specification, including attached claims, will be described.

The term "holder" is not limited to "key holder" but means any matter to which something handy to carry about, such as a mascot, a nail clipper, a tool, or the like can be attached. Moreover, the number of the objects attached to the holder is not limited to one, and the shape of the holder or the like also is not limited specifically.

For example, the "key holder" may carry a single key or may carry a plurality of keys. Furthermore, any shape, for example, such as the shape of a bar, a pouch, or a purse, can be given to the holder. Moreover, any kind of attaching means can be used, for example, an attaching means using metal, string or the like, or attaching means using sticky material as long as keys can be attached. In short, the "holder" according to the present invention can be very widely interpreted. The term "key" means, of course, a so-called "key", as well as a "card" or items similar to these.

While the definition of terminology used in this specification including the attached claims has been described, the "holder" according to some embodiments of the present invention is constituted at least by a plurality of light-emitting elements and a signal generator, or constituted at least by a plurality of light-emitting elements and a key.

Figure 1:
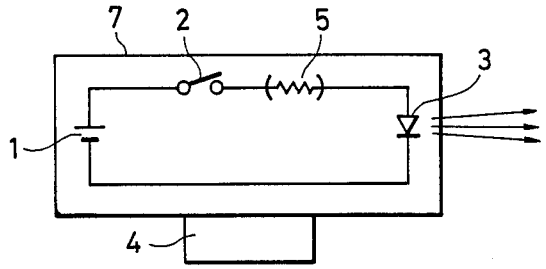
FIG. 1 is a view showing an example of the arrangement of the semiconductor lighting device according to one of the embodiments the present invention.

FIG. 1 shows an example of a structure of the semiconductor lighting device according to one aspect of the present invention. Shown in this figure are an electric power source 1, a switch 2, a light-emitting element 3 such as a light-emitting diode, and connecting means 4. It is not always necessary, however, to arrange the electric power source 1, the switch 2, and a current limiting resistor 5 integrally with each other within a casing 7, but these members may be arranged separately from the casing 7. The current limiting resistor 5 is not necessarily required.

Before performing an operation, the portable lighting device is attached to a key, a tool, or the like, through the connecting means 4.

Of course, the portable lighting device may be attached to the key or the like beforehand, especially if the portable lighting device is used in conjunction with only one key 6. Upon turning-on of the switch 2, an electric current flows from the electric power source through the current limiting resistor 5 into the light-emitting element 3 so that light for illumination is emitted from the light-emitting element 3. An operation is performed while illuminating a keyhole, a working place, or the like, with the emitted light. This lighting facilitates operations in the dark.

Figure 2A:
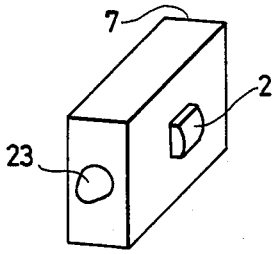
FIGS. 2(*a*) and 2(*b*) are views showing an embodiment according to the present invention.
Figure 2B:
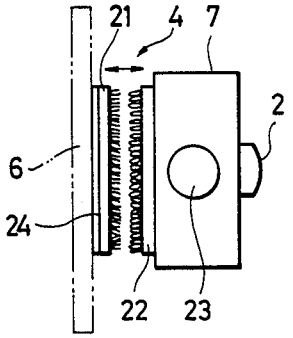

FIG. 2 shows an embodiment of the semiconductor lighting device according to the present invention. FIG. 2(*a*) is a perspective view showing the entire device and FIG. 2(*b*) is a view showing the connecting means in detail. A radiation surface 23 transmits the illumination light emitted from the light-emitting element 3 incorporated in the lighting device. The radiation surface 23 is formed of a transparent resin material or the like. It is effective to perform surface processing on the radiation surface 23 to obtain scattered light. It is also effective to provide a lens. Although FIG. 2 shows the case where the radiation surface 23 projects from the surface of the casing 7 of the lighting device, it is a matter of course that the lighting device may have such a form that the radiation surface 23 is formed on the surface of the casing. In view of reliability and life, it is practical to use a light emitting diode as the light-emitting element 3.

Although the switch 2 may be of the momentary contact type or of the bistable type, the latter is more convenient in view of its operating property. As shown in FIG. 2(*b*), the connecting means has a support 21 provided at its surface with a large number of loops, and another support 22 provided at its surface with a large number of hooks, so that the loops and the hooks can be engaged with each other, that is, the connecting means has such a structure as generally used in a fastener or the like of the Velcro type. The one support 22 may be stuck to the casing 7 of the lighting device beforehand, while the other support 21 may be stuck to the key 6 or other tool through an adhesive tape 24 or the like attached on the support 21 beforehand. In the case where a plurality of keys 6 are used, a separate support 21 is stuck to each key 6.

Thus, the lighting device can be removably connected to the key 6 or the like as the need arises. Since the lighting device is not limited to a single key or a single tool, according to their present invention, the object to be connected to the lighting device may be any of a large number of objects. For example, the lighting device can be applied to bag-like key holder having a plurality of keys, a combination of a key and another member, a tool of a combination of a driver and cutting pliers, etc.

Figure 3A:
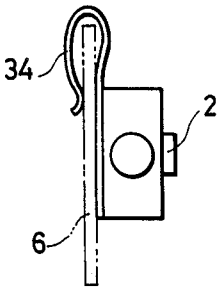
FIGS. 3(*a*), 3(*b*), 4(*a*) and 4(*b*) are views showing other embodiments according to the present invention.
Figure 3B:
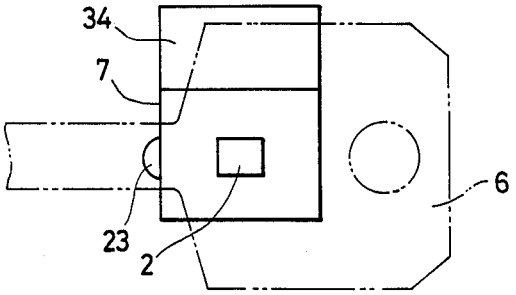

Another embodiment of the present invention is shown in FIGS. 3(*a*) and 3(*b*). FIG. 3(*a*) is a front view and FIG. 3(*b*) is a side view.

Figure 4A:
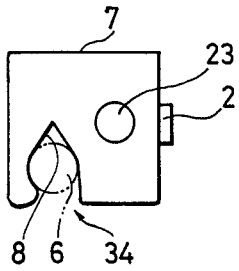
Figure 4B:
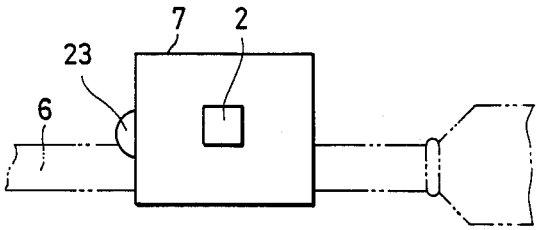

A connecting means 34 is of the clipping type using a leaf spring or the like to clip to the key 6, or the like. The key 6 is removably connected to the lighting device by being pressed by means of the connecting means 34. The connecting means 34 is not limited to the structure of a leaf spring as shown in the drawing, but any kind of structure is applicable to the connecting means as long as such a clipping function can be attained. For example, in the case of a tool having cylindrical shape, such as a screw driver or a nut driver, the lighting device may have its casing formed of a flexible solid material such as rubber, plastic, or the like, as shown in FIG. 4(*a*), so as to integrally form the connecting means 34 for carrying the tool 6 by clamping the tool 6. The embodiment shown in FIGS. 4(*a*) and 4(*b*) can be applied to a case where the lighting device connected to a key or the like owing to the shape of a groove 7. The lighting device according to the present invention is not limited in shape to the above-mentioned embodiment, but it is needless to say that any other shape, such as a cylindrical one, or the like, may be employed. Further, the connecting means is not limited to the above-mentioned embodiment, but may have such a structure having an attaching member relying on screw-fastening although a screw-fastening is not linearly engageable as are the other embodiments.

As described above, according to the present invention, the lighting device can be removably connected with a key, a tool, or the like, so as to illuminate a keyhole or a work place to thereby make it possible, in the time of darkness or in performing fine work, to perform the turning on/off of the key or perform the work with only one hand and to perform the work easily and accurately, without using both hands. Further, the lighting devices can be simply manufactured with remarkable advantage in industrial use.

Figure 5:
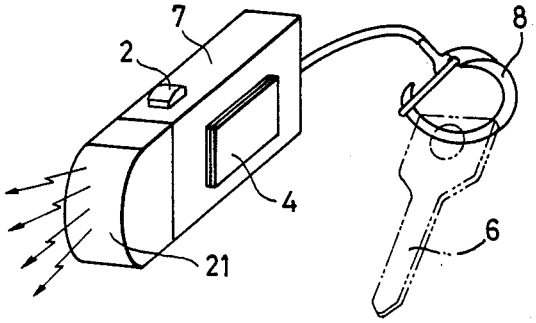
FIG. 5 is a showing an other embodiment of the present invention.

Another embodiment of the present invention is shown in FIG. 5. FIG. 5 is a perspective view showing the device as a whole, showing an example of key-holding or connecting means 4. The reference numeral 21 designates a radiation surface for transmitting the illumination light emitted from the light-emitting element. A radiation surface 21 is formed of a transparent resin material or the like. It is a matter of course that a surface treating technique used in packaging of a light emitting diode is applied to the radiation surface 21 in order to obtain scattered light. The switch 2 controls the light emission. The key holder and a key 6 can be connected or disconnected by means of the key holding means 4. The key 6 can also be flexibly attached to the casing 7 of the device through a conventional chain and releasable grasp 8.

Figure 6A:
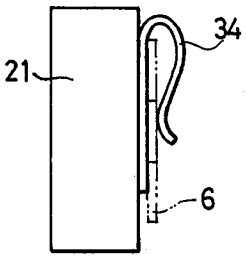
FIGS. 6(*a*) and 6(*b*) are views showing still another embodiment of the present invention.
Figure 6B:
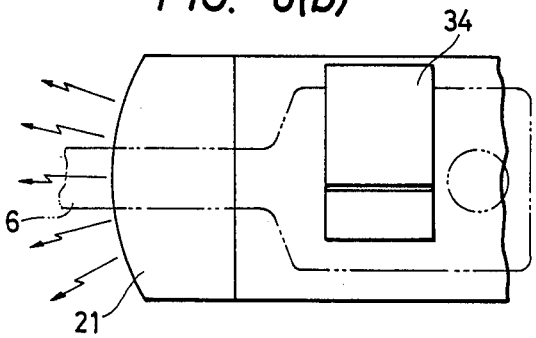
Figure 7:
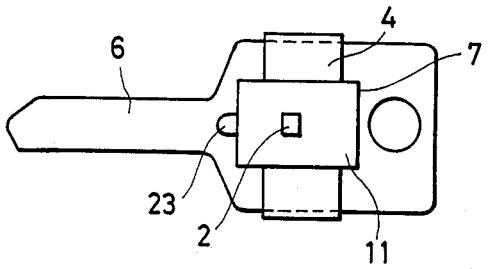
FIG. 7 is a view showing a further embodiment of the present invention.

Another embodiment of the present invention is shown in FIGS. 6(*a*) and 6(*b*). FIG. 6(*a*) is a front view and FIG. 6(*b*) is a side view. This embodiment differs from that of FIGS. 3(*a*) and 3(*b*) principally in the size of the radiation surface 21.

The present invention is not limited to the specific embodiments described above and, for example, a miniaturized key holder body may be attached to a key. A further embodiment in this case is shown in FIG. 6. The shape of the key holder body 7 in the present invention is not limited to the specific shape lllustrated in the drawing, but it is a matter of course that any kind of shape, such as a cylindrical shape or the like, is applicable. In addition, the structure of the key-holding means is not limited to the specific embodiment. For example, the key-holding means may have such a structure that a fixing member has a screwing function or such a structure that the key-holding means is formed integrally with the body.

As described above, according to the present invention, the key holder and a key can be removably attached to each other and the light can be directed to a keyhole by the light-emitting illuminating element incorporated in the key holder. Accordingly, the turning on/off of the key can be easily made with only one hand even in difficult light conditions in darkness, with a very useful effect.

Figure 8:
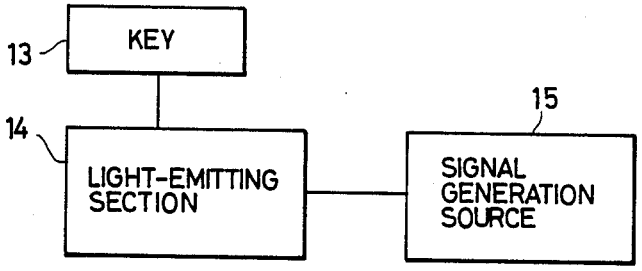
FIG. 8 is a block diagram showing an example of the structure of the key part of the locking/unlocking device according to another aspect of the present invention.

FIG. 8 is a basic constituent diagram showing another embodiment of the locking/unlocking device according to the present invention.

The drawing shows a key 13, a light-emitting section 14, and a signal generation source 15. The locking/unlocking device according to the present invention consists of at least these three elements.

Although the key 13 and the light-emitting section 14 are connected with each other in the basic constituent diagram of FIG. 8, it is not always necessary that the key 13 and the light-emitting portion 14 are integrally formed with each other but may be formed separately from each other. That is, the key 13 in use at present can be used as it is, and only the light-emitting section 14 is selected in use from various separately formed light-emitting sections so as to form a proper combination with the key 13. The signal generation source 15 and the light-emitting section 14 are not always necessarily formed integrally with each other similarly to the relation between the key 13 and the light-emitting section 14, but may be formed to be separate bodies from each other. This is a matter of design.

The locking/unlocking device according to this embodiment of the present invention is arranged to operate not only by means of the key but also only under the conditions that a light-emitting element of the light-emitting portion 14 emits a signal light specified by a predetermined wavelength, a predetermined wave form or the like, in response to a predetermined output signal produced from the signal generation source 3. The emitted light signal must coincide with a signal stored in a light-receiving device provided in the object having a lock function such as a door, a safe, a lock, or the like.

It is a matter of course that the lock cannot be opened when the signal from the light-emitting portion 2 is different from the signal stored in the object having the lock function. If the locking/unlocking device is coupled with any alarm device, or the like, an alarm can be generated in the case where the lock cannot be opened due to the difference between the signals.

Next, the operation of the signal used also for illumination will be described.

Because the signal light can be transmitted with a predetermined combination of pulses each having an extremely short pulse width, it is sufficient if the light signal is emitted for a short time during a lighting period. However, during the lighting period, illuminating light is emitted over a relatively long time. It is possible to perform a double function of emitting the signal light without being detected at all by human eyes, while emitting illuminating light.

For example, if a light emitting diode is used as the light-emitting section 14, pulses having a repetition frequency of $10^7$ per second can be used.

In the case where illumination is not needed at all, it is preferable to set the signal light to have a wavelength not longer than 400 nm or not shorter than 700 nm so as to be invisible. It is thereby possible to emit the signal light without being detected by the eyes of any other person.

If the key 13 and the light-emitting section 14 are formed integrally with each other, for example, in the form of a bar, it is possible to open the lock, not by mechanical means but entirely electrically, by simply inserting the key into the lock. That is, it is possible to produce a signal only when the signal light is applied to a proper position of the object having a locking function.

The external form of the lighting device may be similar to that shown in FIGS. 2(*a*) and 2(*b*) so that the case 7 of the light-emitting section 14 may be attached or detached from the key 6 or 13 as needed. Alternatively the embodiments of FIGS. 3(*a*), 3(*b*), 4(*a*) and 4(*b*) may be used.

The light signal may be, for example, a pulse signal which cannot be detected by human eyes or may be light having such a wave-length to render the light invisible. In view of reliability and life, it is practical to use a light emitting diode as the light-emitting element 14. Although the switch 2 may be of the momentary type or of the bistable type, the bistable type is more convenient in view of property of operation.

The switch 2 may be of the button-type which is provided with one or more buttons so that a signal can be generated by using one or more of the buttons in accordance with the stored signal. Alternatively, the switch 2 may be of the notch type so that a correct signal is generated only when a particular number is pushed.

Figure 9:
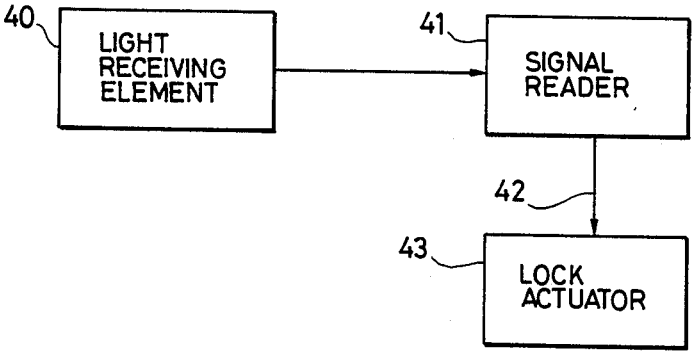

FIG. 9 shows an embodiment of a lock portion of the system. This figure shows a light-receiving element such as a pin photodiode of silicon. A signal reader 41 produces an output signal produced 42 when a signal produced from a key is correct. A lock actuator 43 opens the lock in response to the output signal 42. When the signal reader 41 judges that a light signal produced from a light-emitting section 14 is correct, the output signal 42 for the lock actuator 43 is produced to thereby open the lock.

The arrangement of the elements in FIG. 9 can be composed of well-known electronic circuits. The light-receiving element 40 is not limited to such a pin photodiode, but may be an avalanche diode, a phototransistor, or the like, or may be a cadmium sulfide cell when the speed of the light pulse is low. That is to say, any kind of light-receiving element may be used so long as it has a sensitivity with respect to the light signal from the light-emitting portion.

Although the locking/unlocking device according to this aspect of the present invention has been described by way of some embodiments, it is needless to say that the present invention can be suitably modified without being limited to the above-mentioned embodiments. Further, the object to be connected with the locking-/unlocking device provided with the signal source according to the present invention is not limited to a single key but may be a pouch-like key holder having a plurality of keys, a combination of a key and other things, and so on. The locking/unlocking device may be attached to any of them, and the number of the items and the portion to be connected are a matter of choice for the user. Thus, the locking/unlocking device can be extremely widely used.

For example, for a key holder having a plurality of key attaching portions, a user may as desired attach the locking/unlocking device to any portion or portions, for example to a single key or to a part or to all of a plurality of keys attached to the key attaching portions, to the inside or outside of the body of the key holder directly or indirectly, to a portion or to each of portions of the key holder body, or to one side or to the opposite sides of the key holder body.

As described above, according to the present invention, the locking/unlocking device having the signal source for generating a predetermined signal can be removably connected to a key, a key holder body, or the like, and even if the key, the key holder, or the like, is dropped, lost, or stolen, the lock is never opened by any other person to assure safety. Further, if the light-emitting element is also provided, the key can be correctly, speedily, safely turned on/off while lighting, without being noticed by any other person, even in darkness, and there is such a remarkable advantage that the locking/unlocking device can be easily manufactured.

Turning now to yet another set of embodiments of the invention, a plurality of multi-color light-emitting elements may be used as the light-emitting elements, or alternatively a plurality of monochromatic light-emitting elements may be used as the light-emitting elements. For example, when light emitting diodes are used as the light-emitting elements, they are superior in performance, reliability, cost, and lifetime.

The signal generator is provided to control the lighting condition of the plurality of light-emitting elements, and will be described in detail later with respect to the embodiments.

The plurality of light-emitting elements and the signal generator, or the plurality of light-emitting elements and the key may be formed integrally or separately.

An example of a "key holder" will be now described. The plurality of light-emitting elements and the key may be separated from the holder. Either of the light-emitting elements or the key may be united with the holder, or both of them may be united with the holder. It does not always follow that all of the light-emitting elements are united with the holder or separated from the holder. For example, when a plurality of groups each consisting of three multi-color light-emitting diodes, red, yellowish green, and blue, are prepared for use as the light-emitting elements, one of the groups may be united with the holder and the other groups may be separated from the holder. On the other hand, the relation between the signal generator and the plurality of light-emitting elements is similar to the relation between the key and the plurality of light-emitting elements. Whether they are united or separated, can be freely selected as a matter of design.

The holder according to these embodiments of the present invention radiates signal light, such as specific wavelength light, blinking light or the like, from a required light-emitting element or a combination of some light-emitting elements corresponding to the output signal generated through the signal generator.

To take the case of "key holder" as an example, an unlocking operation can made with a key, a card or the like, only when signal light generated from the holder's side agrees with the signal stored in a light-receiving device of a subject having a locking function, such as a door, a cashbox or a lock.

Of course, when the signal from the lighte-mitting elements and the storage signal of the subject having a locking function are not in agreement, the lock may not be opened. Furthermore, in this case, warning can be given in combination with an alarm device or the like.

In the case where the key and the light-emitting elements are united, the lock can be opened by a simple inserting operation but the opening is performed not mechanically but electrically as long as the holder is shaped like a bar or a plate. In short, it can be designed so that the signal is not generated when the signal light of the key portion is not at a proper position of the object having a locking function.

Although "key holder" has been described by way of example, it is to be understood that the operation of the light-emitting elements or the like described above is not limited to the key holder but the same operation applies to any other holders according to the present invention.

In addition, by combinations of a plurality of multi-color light-emitting elements, color changes in emitted light can be obtained, and color signals for making a light signal can be used also for various communications or the like.

Figure 10A:
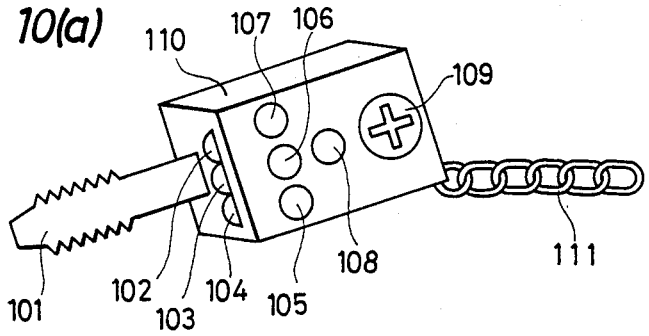
FIGS. 10(*a*) and 10(*b*) are views of a key holder of a multi-light embodiment of the present invention.
Figure 10B:
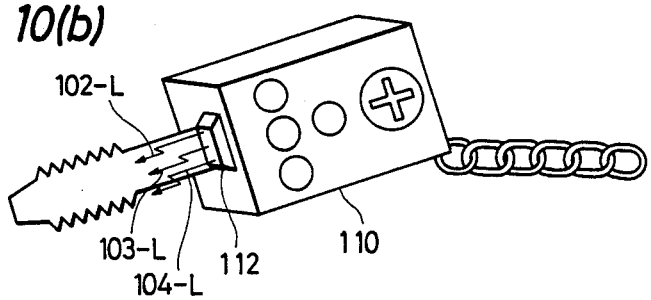

FIG. 10(*a*) shows a key holder as an embodiment of the present invention with multiple light emitters. A key 101 is fixed to a support 110 to form a close fixation structure whereby locking and unlocking operations can be performed by grasping the support 110 with one hand. Also a switching operation for light emitting can be made with the same one hand. Light-emitting elements 102, 103 and 104 emit light of different colors. For example, the light-emitting element 102 may be a light emitting diode formed from $Ga_xAl_{1-x}As$ to emit red light, the light-emitting element 103 may be a light emitting diode formed from GaPN to emit yellowish green light, and the light-emitting element 104 may be a light emitting diode formed from ZnSe to emit blue light. That is, a group of the light-emitting elements are constituted by a plurality of light-emitting materials.

There are four lighting switches 105, 106, 107 and 108 in the drawing. For example, the lighting switch 105 is used for red light, the lighting switch 106 is for yellowish green light, the lighting switch 107 is for blue light, and the lighting switch 108 is for switching all the light-emitting elements.

Figure 11A:
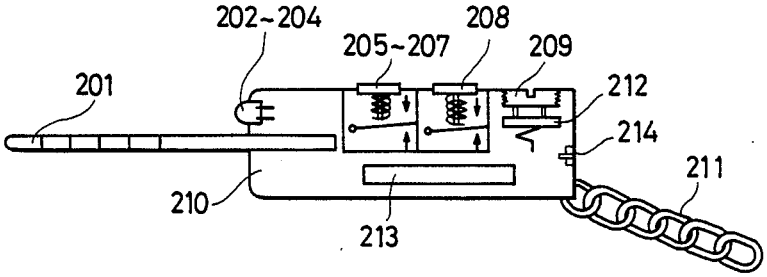
FIGS. 11(*a*) and 11(*b*) are sectional views of the key holder of FIGS. 10(*a*) and 10(*b*).
Figure 11B:
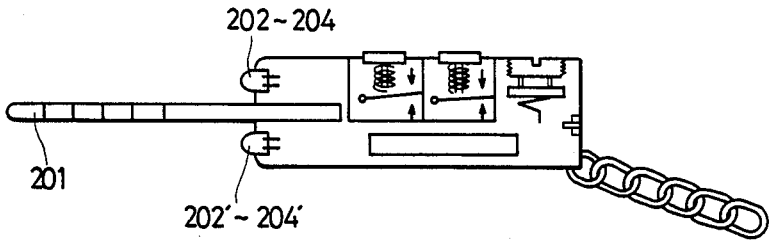

An electric source is constituted by a dry battery or the like stored in a battery chamber. Alternatively, the electric source may be constituted by a rechargeable storage battery or the like which can at any time be electrically charged through a charge socket 214, as shown in FIG. 11(*a*). When the battery chamber for storing the battery is formed within the support portion 110, it is unnecessary to provide an external member such as a battery case or the like. Accordingly accidents of breaking the connecting wire or the inconvenience of carrying a separate battery case during use can be prevented. In FIG. 10(*a*), a cover 109 makes the battery chamber airtight. The battery is stored in the battery chamber by screwing the cover 109. In the drawing, a chain 111 is used for connecting other keys, mascots, or the like, or for the connection to the human body, etc.

FIG. 10(*b*) shows an example of the structure in which the light-emitting diodes (described above with reference to FIG. 11(*a*)) are integrally molded. In the drawing, a molded body 112 is formed by molding the light emitting diodes and is featured in that the respectively colored light, e.g., red light 102-L, yellowish green light 103-L and blue light 104-L, can be emitted from a single molded body 112. If the molded body 112 is formed to be inserted into the support portion 110 and if electrodes are formed to connect closely to side wiring in the main body, replacement can be made instantly. Accordingly, this is useful in the case where the light-emitting elements are replaced by other ones, or in the case where inferior portions are detected.

FIG. 11(*a*) is a sectional view showing an embodiment of the present invention. In the drawing, a key 201 is fixed to a support portion 210. In the drawing, a plurality of light-emitting elements 202–204 are composed of different materials, as described above with reference to FIG. 10 (*a*). Light switches 205–207 control the light emitting of each of the respective colors as described above. A switch 208 controls the emission of light from all the light-emitting elements 202–204. These switches 205–208 are integrated in the support portion 210 and processed to be water proof to thereby prevent deterioration of the electrical parts. A battery 212, as described above, is tightly closed with a cover 209 and is provided with electrical connections. A storage battery capable of being recharged through a charge socket 214 by a charging current supplied from outside can be used as the battery 212. Such a storage battery can be used for a long time without replacement. A signal control portion 213 supplies a signal current for the light-emitting elements 202–204. The signal control portion 213 mainly performs processing for switching a pulse-modulated current to the light-emitting elements and for switching a current with respect to each of the light-emitting elements.

FIG. 11(*b*) shows the case where a plurality of light-emtting elements 202–204 and 202'–204' are provided on each side of the key 201 to make light radiate from the opposite sides of the key 201. As a result, the key is prevented from creating a shadow of the illumination light. Of course, a member formed by integrally molding a plurality of light emitting diodes as described above may be used.

Figure 12:
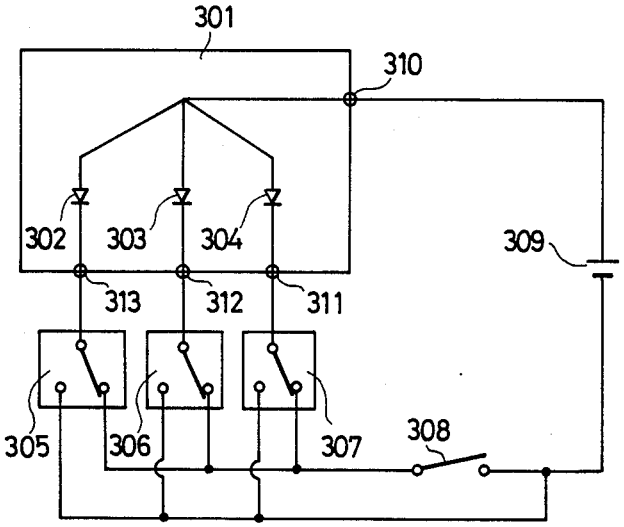
FIG. 12 is a circuit diagram showing an example of the basic electrical wiring use for turning on a plurality of light-emitting elements.

FIG. 12 shows an example of the basic electric circuit for turning on the light-emitting elements as described above in reference to FIGS. 10(*a*) to 11(*b*). In th drawing, a light emitting diode package 301 is formed by integrally molding a plurality of light emitting diodes 302–304. When three light emitting diodes are provided, four wiring electrodes can be used as interior wiring as shown in the drawing. Alternatively, as described below, only three wiring electrodes can be used. A source battery 309 may be a storage battery capable of being recharged, as described above. The battery 309 is connected to a common electrode 310 for the light-emiting diode package 301. Each of the light-emitting diodes, 302–304 is connected through respective electrodes 311–313 to respective lighting switches 305–307. Single-pole double-throw type switches are used in this embodiment for the lighting switches 305–307. These separate switches 305–307 are normally connected to a common overall-lighting switch 308 so that all the light emitting diodes 302–304 can be turned on at the same time. In the case where the light emitting diodes 302–304 are individually turned on, any one of the lighting switches 305–307 is turned on by the operation of a push-button or the like to thereby effect individual lighting. In the case of FIG. 12, the light emitting diode 302 can be turned on and off by the operation of the switch 304; the light emitting diode 303 can be turned on and off by the operation of the switch 306; and the light emitting diode 304 can be turned on and off by the operation of the switch 307. All the light emitting diodes can be turned on and off at the same time by the operation of the common switch 308.

Figure 13A:
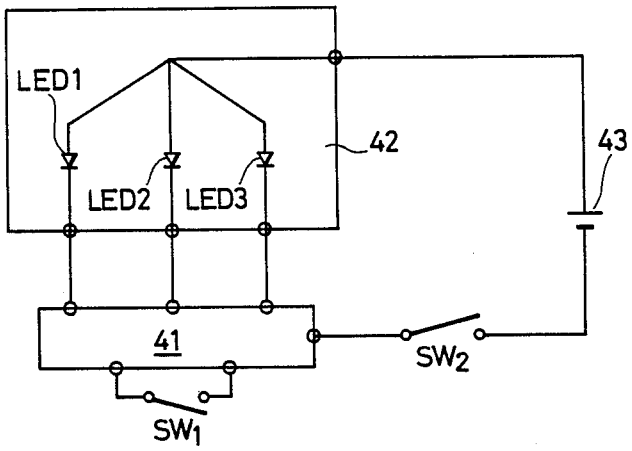
FIGS. 13(*a*) and 13(*b*) are circuit diagrams showing the case in which a plurality of light-emitting diodes are switched by one change-over switch.
Figure 13B:
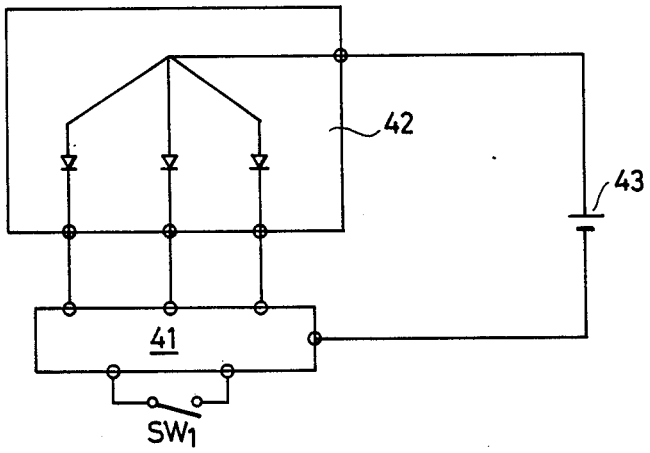

FIG. 13(*a*) shows an embodiment having such an arrangement that the switches respectively connected to the light emitting diodes as described above can be changed over by a single switch through a switching control circuit 41.

Figure 14:
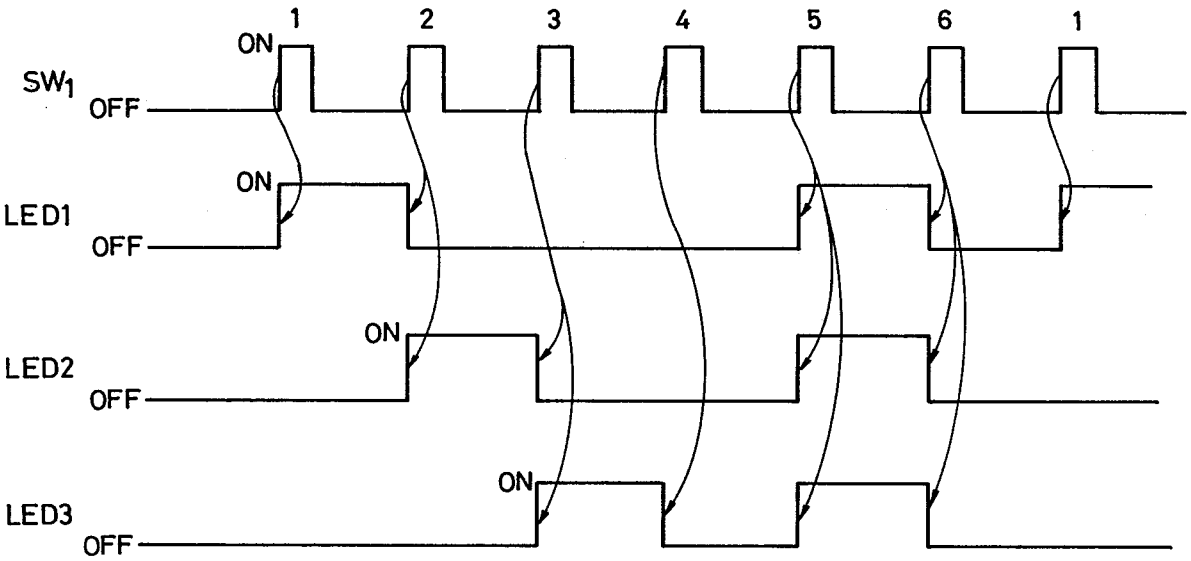
FIG. 14 is a timing diagram of the light emission in the embodiment of FIGS. 13(*a*) and 13(*b*).

In the drawing, a power switch $SW_2$ can be eliminated, as shown in FIG. 13(*b*) in the case where current consumption of the switching control circuit 41 is low. In FIG. 13(*a*), the light emitting diodes LED1–LED3 are separately connected to the switching control circuit 41, so that a switching operation for the diodes can be performed by the switch $SW_1$ through the electric circuit of the switching control circuit 41. The timing diagrams for light emitting in this case are shown in FIG. 14. In the drawing, when the switch $SW_1$ is in the state of ON-1, that is, when the switch is operated once, LED1 turns on. When the switch is operated once more into the state of ON-2, LED1 turns off and LED2 turns on. Similarly, in the state of ON-3, LED2 turns off and LED3 turns on. In the state of ON-4, LED3 turns off, and in the state of ON-5, all LEDs turn on. Because the above-described procedures can be repeated, this embodiment is featured in that necessary color light can be selected by the operation of a single switch.

Figure 15A:
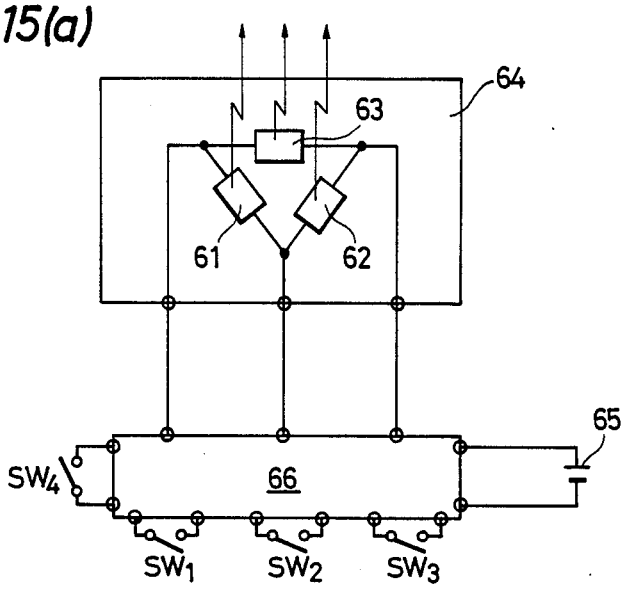
FIGS. 15(*a*) and 15(*b*) are circuit diagrams showing the case where three light-emitting elements are molded together.
Figure 15B:
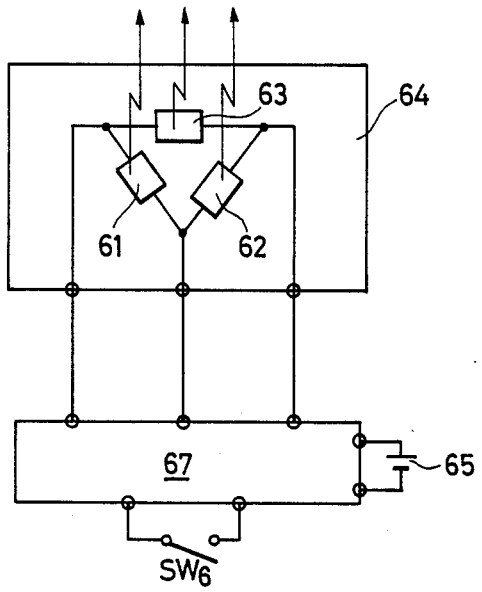

FIG. 15(*a*) is a wiring diagram of a molded package 64 which is formed by molding three light-emitting elements and has three electrodes for external wiring connected to a switching control circuit 66. By applying current pulses or alternating phase-changing current to each of the three points, individual-lighting or total-lighting can be effected owing to the diode characteristic of light emitting diodes 61–63. Switches SW1–SW3 select individual color light, and $SW_4$ is a switch for total lighting. FIG. 15(*b*) shows an embodiment in which the light emitting diodes are individually or totally controlled by a single switch as described above in reference to FIGS. 13(*a*) to 14. In the drawing, a control circuit 67 controls the lighting in the light emitting diodes 61–63, the molded package 64 having the three light emitting diodes.

Figure 16:
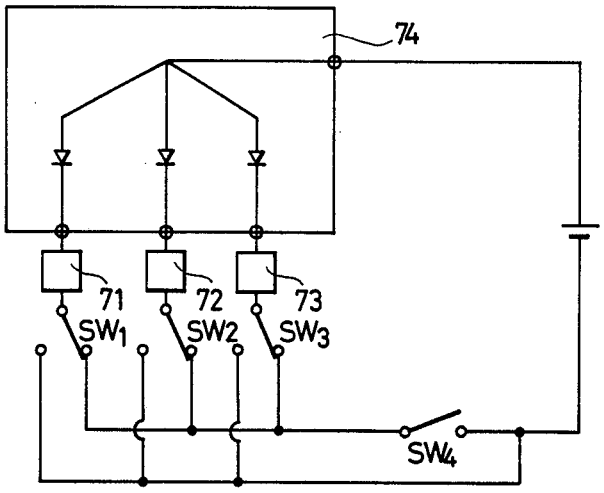
FIGS. 16 and 17 are circuit diagrams showing an embodiment in which pulse modulation is applied to the light-emitting elements to perform signal-transmission.
Figure 17:
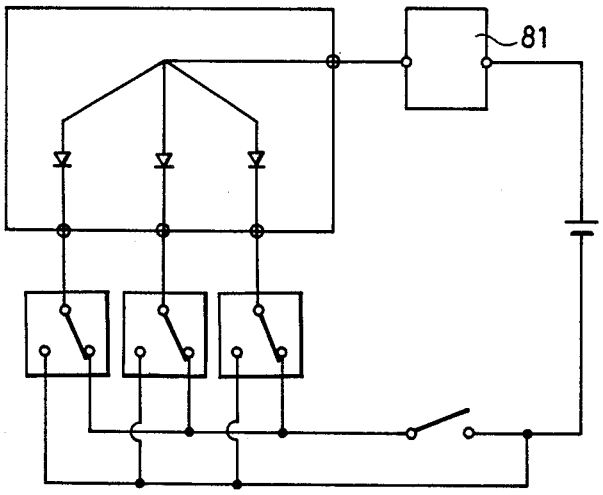
Figure 19:
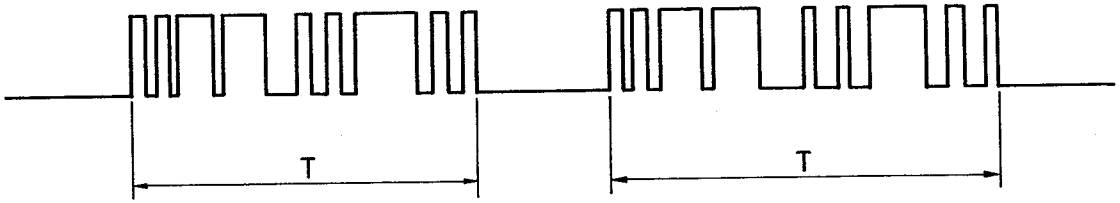
FIG. 19 is a timing diagram showing the wave forms of the modulated light.

FIG. 16 shows an embodiment in which pulse modulation or the like is applied to the light-emitting elements to thereby perform signal-transmission. In the drawing, a molded package 74 has inside-wiring, a plurality of light emitting diodes and electrodes connected to signal generating circuits 71–73. The signal generating circuits 71–73 are connected to the respective change-over switches, as described above in the embodiment of FIG. 12, so that individual- and total-lighting can be performed. When any one of the switches is turned on, the current flowing in the light emitting diode is changed into modulated current, as shown in FIG. 19 as an example, by the signal generating circuit 71, 72 or 73, so that the emitted light is changed into modulated light. In the embodiment of FIG. 16, each of the signal generating circuits 71–73 is connected to only one LED. That is, the signal generating circuits 71–73 are connected with respect to the emitted color light to thereby produce individually modulated light. In the case where the modulated signal is of one kind, only one signal generating circuit 81, as shown in FIG. 17, needs to be connected. For example, in the case of pulse modulation, the modulated light can be used as illumination light without the feeling of flickering as long as the signal portion T of FIG. 19 is repeated at a speed of 20 cycles or more per second or preferably at a speed of 30 cycles or more per second. The modulated signal is featured in that it can be used for information-transmission and particularly that it can be used as an unlocking signal for opening a lock.

Figure 18:
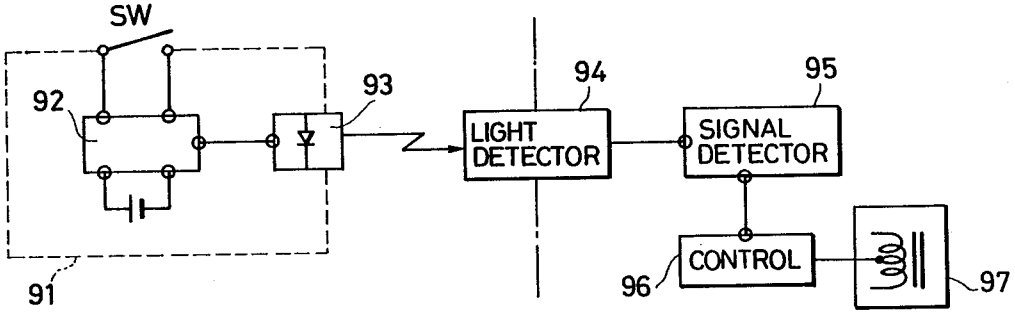
FIG. 18 is a diagram showing an example of unlocking system according to the modulated light embodiment.

FIG. 18 shows a specific embodiment of the unlocking system relying on the modulated light signal transmission. In the drawing, a support portion 91 includes elements for producing modulated color light. The support portion 91 is composed of a signal generating circuit 92 in the form of an IC chip, and a package 93 is formed by molding a single or a plurality of light emitting diodes, a switch SW and the like.

Modulated output light entering into a light-receiving element 94 provided in the vicinity of a keyhole or a lock is transferred as a modulated electric signal into a signal judging section 95 in the form of an IC chip. If the modulated signal has the same signal as that of a personal signal memorized beforehand, a coincidence signal is transmitted to an unlocking control circuit 96 to thereby drive an unlocking mechanism 97 to open the lock. The switching operation can be performed with one hand by the use of this mechanism, and the illumination light can be directed to the key hole or in the vicinity of the lock to thereby perform the unlocking. Because the modulated signal stored in the signal generating portion and the code stored in the signal judging portion are coincident in form, the code can be changed by the replacement of the pair of IC chips according to demand. Accordingly, by the replacement of the IC chips, it is possible to prevent another person from taking copies of the personal code to commit a crime or the like. Furthermore, even in the case where the holder portion is lost, it is sufficient to make the IC chip in the signal generating portion of a new holder portion agree with the IC chip in the signal judging portion, so that there is advantageously no necessity of replacing the entire lock, as is conventionally done.

Although the specific embodiments of the holder have been described above, a plurality of packages respectively formed by molding a plurality of light emitting diodes may be used in combination for various modification. Furthermore, although the ON-OFF switching has been described by way of example, the intensity of the emitted light may be changed by the use of changes in resistance owing to pressure to hereby perform switching of the intensity in illumination light, switching of color light, or the like. Moreover, although the light emitting diode has been described as an example of the light-emitting element, any other elements may be used to realize the invention without departing from the spirit thereof. In addition, in combination of colors in emitted light, various colors may be used, or a plurality of colors in mono-color light may be used.

The holder of this aspect of the present invention has a plurality of light-emitting elements and a signal generator provided integrally or separately, or has a plurality of light-emitting elements and a key provided integrally or separately. Such a holder has the advantage of being miniaturized, light weight, handy to carry about, and can be used for transmission of various kinds of signals. In particular, when the holder is used as a key holder, the holder has the double advantage of simplifying the locking and unlocking under poor lighting conditions and of making the lock safe and secure owing to the stored signal. Furthermore, particularly when light emitting diodes are used as light-emitting elements, the holder has the advantage of being superior in performance, reliability, cost and lifetime.

What is claimed is:

1. An illuminated key, comprising:

a key having a working portion at a first end thereof;

lighting means for projecting light in a first direction, said lighting means comprising a light emitting diode;

at least one switch of a momentary contact type;

signal generating means for impressing a predetermined coded pulse modulated signal on light emitted from said light emitting diode in response to actuation of said switch;

attaching means for detachably attaching said lighting means to said key on a surface thereof extending from said first end to a second end opposite said first end, wherein attachment of said lighting means to said key directs said first direction of said lighting means towards said first end;

a power source; and means for housing said lighting means and said power source.

2. An illuminated key as recited in claim 1, wherein said lighting means includes a plurality of light emitting diodes, said signal generating means impressing said predetermined signal on light emitted from said light emitting diodes in response to actuation of said switch.

3. An illuminated tool as recited in claim 2, wherein said plurality of light emitting diodes comprises at least three said light emitting diodes emitting differently colored light.

4. An illuminated key as recited in claim 3, in which said at three light emitting diodes are molded together.

* * * * *